US006578293B1

(12) United States Patent
Ainsworth et al.

(10) Patent No.: US 6,578,293 B1
(45) Date of Patent: Jun. 17, 2003

(54) SUCTION EXCAVATOR

(75) Inventors: James Howard Ainsworth, Lymm (GB); Andrew Sutherland, Gwynedd (GB); Haydon Parsonage, Clwyd (GB)

(73) Assignee: Lattice Intellectual Property Limited, London (GB)

( * ) Notice: Subject to any disclaimer, the term of this patent is extended or adjusted under 35 U.S.C. 154(b) by 0 days.

(21) Appl. No.: 09/926,198

(22) PCT Filed: Mar. 2, 2000

(86) PCT No.: PCT/GB00/00738

§ 371 (c)(1),
(2), (4) Date: Sep. 24, 2001

(87) PCT Pub. No.: WO00/58566

PCT Pub. Date: Oct. 5, 2000

(30) Foreign Application Priority Data

Mar. 26, 1999 (GB) ..... 9906933
Oct. 21, 1999 (GB) ..... 9924892

(51) Int. Cl.[7] ..... E02F 3/92
(52) U.S. Cl. ..... 37/317; 37/320
(58) Field of Search ..... 37/317, 320, 321; 431/22, 42, 18, 19, 21, 38, 39, 63, 62, 66, 75–90, 356

(56) References Cited

U.S. PATENT DOCUMENTS 3,818,846 A * 6/1974 Reese ..... 110/8 R
3,926,050 A 12/1975 Turner et al.
3,998,626 A * 12/1976 Baum et al. ..... 75/60
4,111,672 A * 9/1978 Battigelli et al. ..... 65/3 C
4,994,187 A * 2/1991 Glaset et al. ..... 210/519
5,057,189 A * 10/1991 Apffel ..... 202/113
5,408,766 A 4/1995 Pobihushchy ..... 37/323
5,560,350 A * 10/1996 Kim ..... 126/113
5,609,829 A * 3/1997 Lucas et al. ..... 422/110
5,666,890 A * 9/1997 Craig ..... 110/229

OTHER PUBLICATIONS

Patent Abstracts of Japan, JP 09–221786, Aug. 26, 1997.

Patent Abstracts of Japan, JP 09–104284, Apr. 22, 1997.

* cited by examiner

*Primary Examiner*—Christopher J. Novosad
(74) *Attorney, Agent, or Firm*—Oblon, Spivak, McClelland, Maier & Neustadt, P.C.

(57) ABSTRACT

A suction excavator including an air pump for generating a flow of air and a nozzle through which air is drawn under the influence of the air pump, the nozzle being arranged when in use to suck up spoil from an excavation, and a mechanism for separating spoil from the air drawn through the nozzle. The excavator is provided with a fuel gas detector to detect for the presence of fuel gas in the flow of air drawn up through the nozzle. When fuel gas is detected a valve may be actuated to interrupt the flow of air up through the nozzle and instead to admit air from a substantially fuel gas free source to flush any fuel gas out of the system reducing the risk of an explosion.

12 Claims, 4 Drawing Sheets

SUCTION EXCAVATOR

BACKGROUND OF THE INVENTION

1. Field of the Invention

The present invention relates to an apparatus for excavating a hole by sucking debris and spoil out of the 2. Discussion of Background Such an apparatus is shown for example in German utility model DE 29902562 U1 which discloses a vehicle with a suction tube to be inserted into a hole or excavation to suck debris and spoil out of the hole, an air pump to cause the suction and a filter to remove the spoil from the airflow.

Excavating holes using a suction excavator as in the above German utility model is advantageous because holes with a much smaller horizontal cross-section can be dug using this device than previous excavations made using drills, spades etc. Excavating using a suction excavator is much quicker than conventional digging techniques, reduces the amount of spoil produced from the hole and the amount of tarmac required to re-fill the hole, causes less damage to tree roots and to other utility pipes and cables and causes much less disruption to pedestrians and drivers if used in a street. However, because of the large volume of air that is sucked through the vehicle, any fuel gas from a leaking gas main for example is likely to be sucked into the vehicle. Any sparks produced within the vehicle, for example from the air pump or static build-up within the vehicle due to the fast movement of air through pipes etc., is likely to cause a spark, igniting the gas and causing an explosion.

SUMMARY OF THE INVENTION

According to a first aspect of the present invention there is provided a suction excavator with a gas sensor arranged to detect for the presence of gas in the passage of air through the suction excavator.

The provision of a gas sensor within the suction excavator enables the presence of potentially dangerous explosive gas within the suction excavator to be determined so that appropriate action can be taken.

There is preferably provided a control means which when gas is detected flushes air through the suction excavator.

All of the components of the suction excavator through which suction air is passed, such as the air pump, suction tube etc., are preferably electrically bonded to each other and a connection between the connected components and earth provided to discharge any electrostatic charge built-up. The bonded components may be connected to earth via electrostatically conducting tyres when the suction excavator is mounted on a vehicle or via an electrically conducting strap, for example.

BRIEF DESCRIPTION OF THE DRAWING FIGURES

An example of a vacuum excavator according to the present invention is shown in the accompanying drawings in which:

FIG. 1 shows an operator excavating a hole by directing the nozzle of a suction tube into the hole;

FIG. 2 diagrammatically shows some elements of the suction excavator;

DETAILED DESCRIPTION OF THE PREFERRED EMBODIMENT

Figure 1:
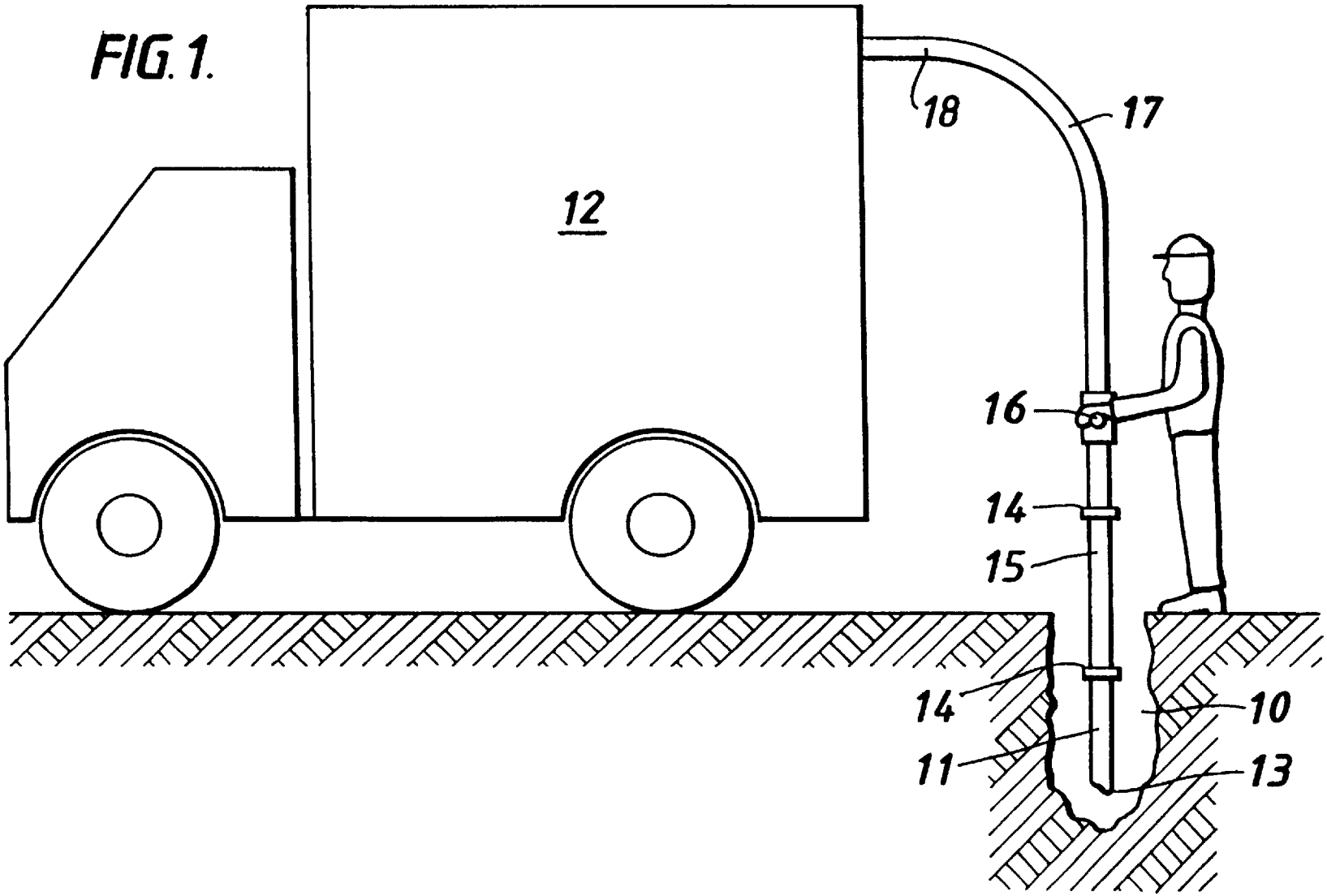

FIG. 1 shows an excavation 10 which may for example be made to reach a subterranean pipe or cable. When in urban areas and the excavation is made into a road or a pavement, a pneumatic drill may initially be used to break into the hard tarmac surface of the ground. A nozzle 11 is connected to an air pump and a filtering unit, which in this case are mounted on a vehicle 12. The nozzle 11 is used to suck up spoil from the excavation 10. If necessary whilst sucking up spoil through nozzle 11 the ground in the excavation 10 may be broken up using, for example, a pole, a spade, a fork, or more preferably an air knife as is well known in the art for delivering a high velocity jet of air. This suction nozzle 11 has a circular cross section of about 25 cm diameter and in this case the periphery of the tip of the nozzle 13 follows an undulating path which is less likely to damage subterranean pipes which the free end of the nozzle 11 may encounter. The nozzle 11 is provided with couplings or brackets 14 into which any number of extension pipes 15 may be inserted to extend the length of the nozzle 11. In this example the nozzle is made from aluminium which is strong and light. The nozzle is provided with an on/off switch, in this case on a handle 16 used by the operator to direct the nozzle. The on/off switch immediately starts/continues or stops suction through the nozzle 11. The switch is preferably arranged such that an operator must constantly apply pressure to it to continue the sucking operation. When the operator stops applying pressure to the switch suction is then immediately stopped. The ability to immediately disengage suction is particularly useful to enable blockages to be cleared from the end of the nozzle and to prevent injury in case the operator or his clothes are accidentally caught in the nozzle. The nozzle is provided with a flexible hose 17 which may be made from heavy duty rubber to connect the nozzle to a boom 18 which may be hydraulically supported for easy operation and which is mounted on the vehicle 12 containing the air pump and filtering equipment.

Figure 2:
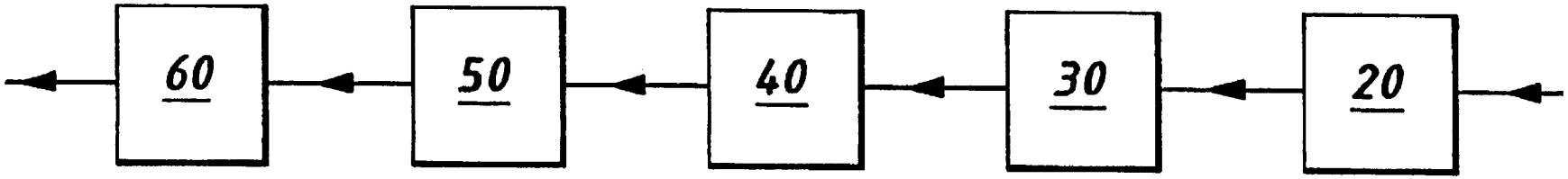

FIG. 2 diagramatically shows an example of the suction and filtering equipment. Suction air and entrained spoil is passed from the nozzle 11 shown in FIG. 1 through boom 18 to a hopper 20, in this case a drop box hopper, to remove the vast majority of the spoil entrained in the suction air. The suction air then passes to a cyclone 30 where it is accelerated and then to a filter 40 where dust and smaller particles are removed from the air. The air then passes through an air pump 50 which in the present example is arranged to pump between 1100 and 1900 cubic metres of air per minute, and suction air is then discharged through exhaust system 60 which includes one or more silencers.

Figure 3:
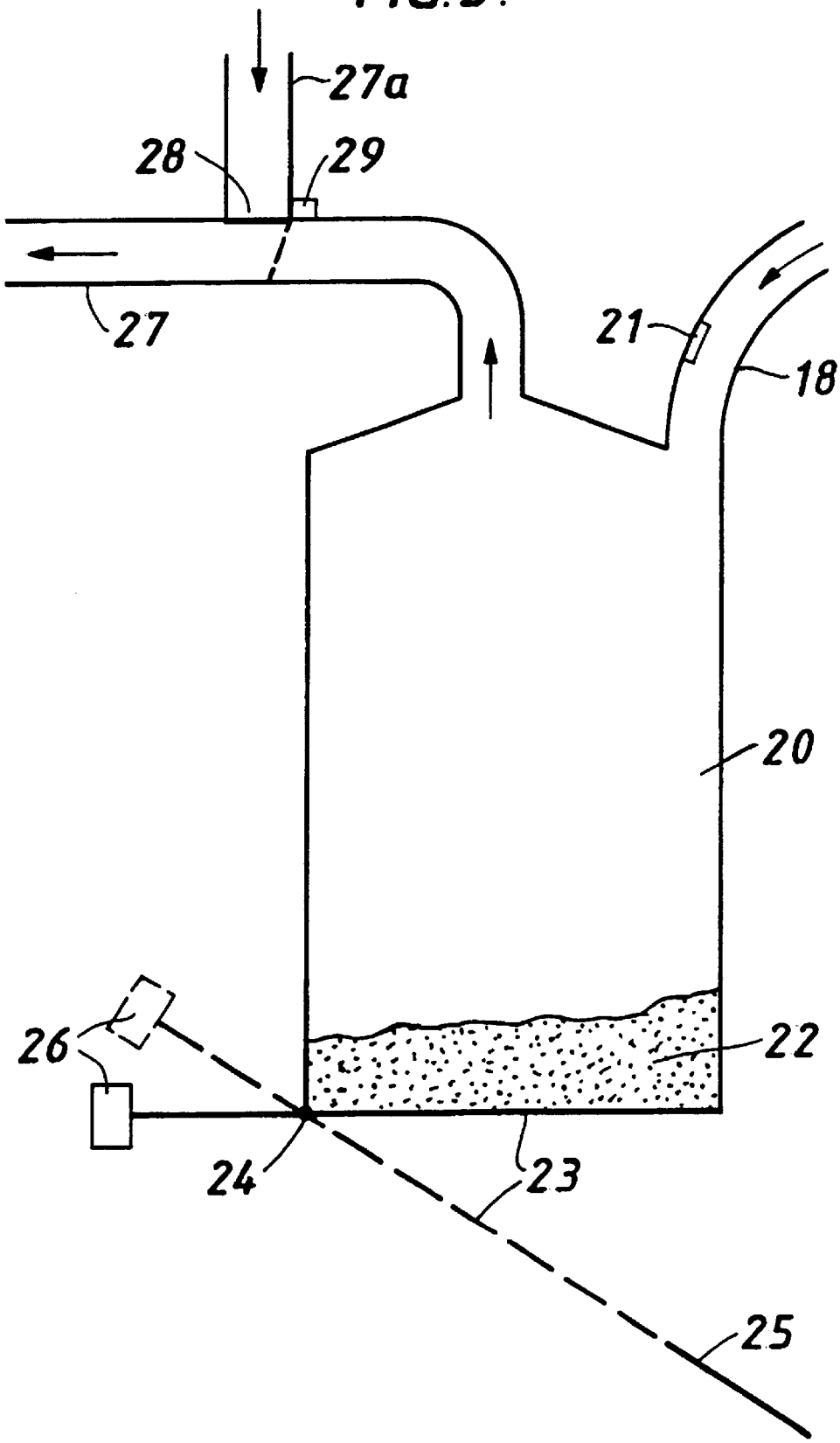
FIG. 3 shows a hopper arranged to receive spoil from the excavation.

FIG. 3 shows the drop box hopper 20 in more detail. Suction air is passed from boom 18 into the hopper 20 past a gas sensor 21 as is well known in the art. Spoil entrained in the incoming air falls under the influence of gravity to the bottom of the hopper 22 where it is collected. The base 23 of the hopper is hinged along one edge 24 and is arranged such that when a particular weight of spoil 22 has accumulated at the bottom of the hopper 20 the base 23 rotates about a hinge along the edge 24 to pass the spoil 22 down a chute 25 for collection or disposal. The base plate 23 is urged upwardly when in use by the passage of the suction air and is only lowered when the weight of spoil exceeds the upward force provided by the suction air. If desired a counterbalance 26 may be provided on the hinged base 23 to adjust the weight of spoil that causes its ejection down chute 25.

The substantially spoil-free air passes out of the hopper 20 through a conduit 27 to cyclone 40. Conduit 27 is provided with a valve 28 and valve actuator 29 arranged, when actuated, to block the passage of air from hopper 20 to conduit 27 and instead admit air from outside into conduit 27, in this case via conduit 27*a*. When not actuated, the valve 28 admits air from hopper 20 into conduit 27 and blocks the passage of air from conduit 27*a* into conduit 27.

The air from conduit 27 is then sucked through a cyclone 30, as is well known in the art, to accelerate the air and then to a filter 40 as is also well known in the art to remove any dust from the suction air. The filter 40 may be regularly cleaned to prevent dust from causing clogging and preventing the passage of air therethrough.

Air from the filter 40 is sucked to the air pump 50 which is preferably powered by the gearbox of the vehicle 12 upon which the air pump and filtering equipment is mounted.

Air from the pump 50 is then passed to silencers 60 as are well known in the art to vent the air and reduce noise.

Figure 4:
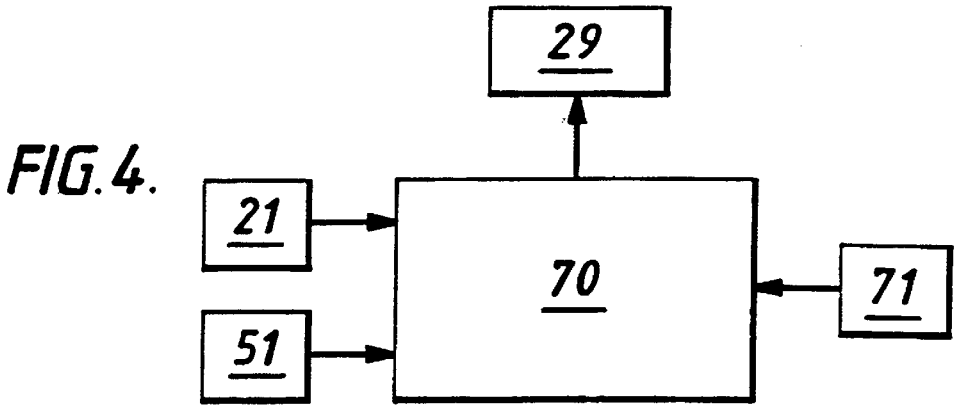
FIG. 4 shows a control system connected to a gas sensor of the suction excavator.

FIG. 4 shows a control system including a control means 70 such as a microprocessor for receiving a signal from gas detector 21. When a signal is received by control means 70 indicating that gas detector 21 has detected explosive gas or a predetermined amount of explosive gas in the boom 18, control means 70 instructs valve actuator 29 to open valve 28 thereby preventing the further suction of air from excavation 10. Instead air is drawn from conduit 27*a* which is in communication with fresh air, for example from above the vehicle 12 to pass the fresh air through the cyclone 30, filter 40, air pump 50 and exhaust system 60 thereby flushing out any fuel gas. A further gas sensor 51 is preferably provided at the suction air inlet of the air pump 50, the actuation of which also opens valve 28 to prevent the further suction of air from the nozzle 11 and instead flushes clean air through the suction excavation system. An audible or visual alarm is preferably activated when a gas detector 21, 51 is activated to advise an operator of the reason for the interruption in suction from the nozzle. In order to reactivate the suction excavation system, a manual re-set 71 must be activated to ensure that the operator is aware of the situation. However, the manual re-set 71 will not close valve 28 until the fuel gas concentration detected by sensor 21, and if used also sensor 51, has fallen below the predetermined level which caused its actuation.

Figure 5:
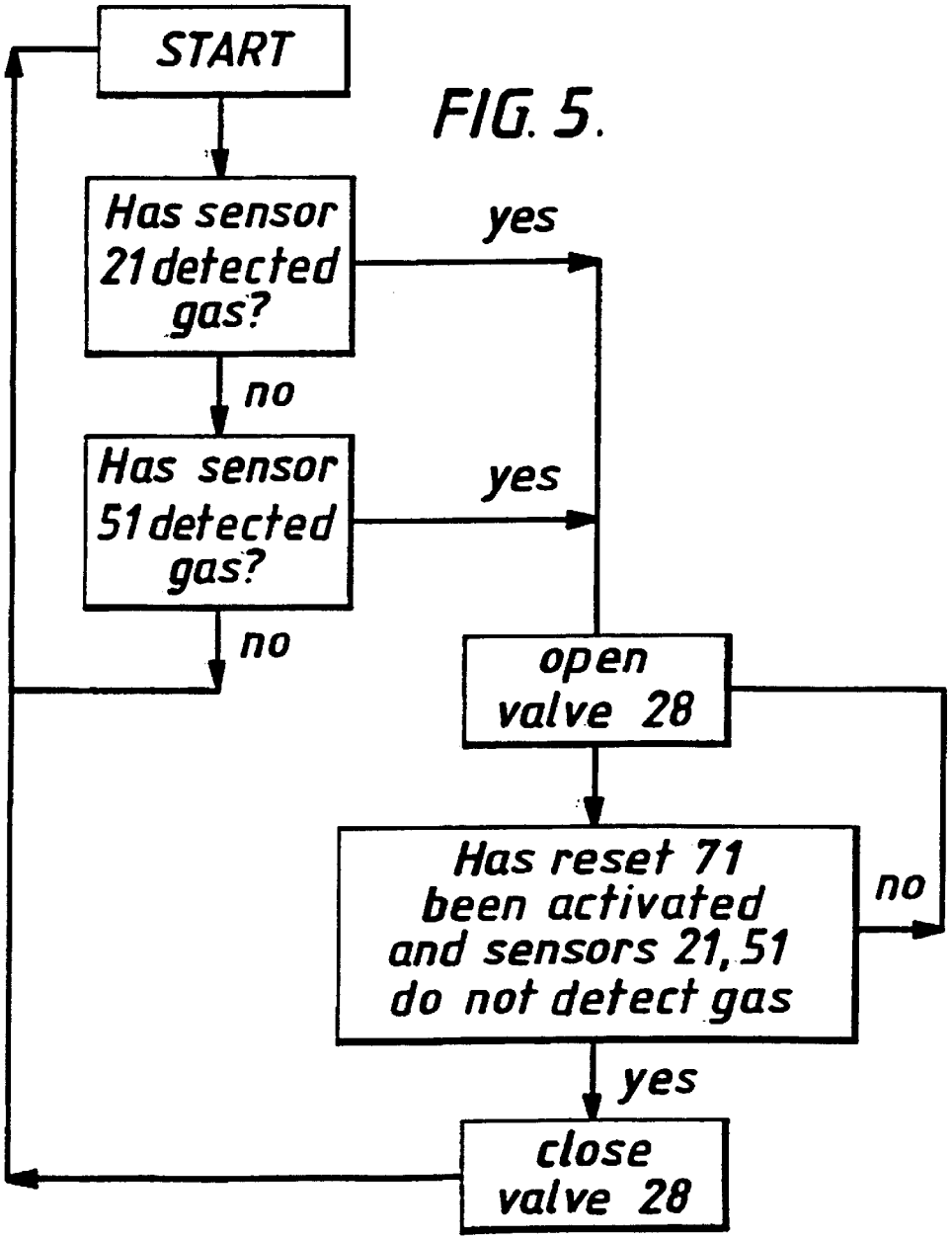
FIG. 5 is a flow diagram showing operation of the control system shown in FIG. 4.

FIG. 5 shows the operation of the control system. The control means 70 continually monitors gas sensors 21 and 51 to see whether a predetermined concentration of explosive gas has been detected. As soon as a predetermined concentration of explosive gas is detected from either sensor, valve 28 is opened and is not closed to permit further suction excavation until the concentration of explosive gas has fallen below the predetermined level and the manual re-set 71 has been activated. The control means 70 preferably continually monitors the concentration of gas detected by the gas sensors 21, 51 and may store the received concentrations, for example on a data logger such as a RAM of a computer for subsequent analysis. The control means 70 may be set to open valve 28 when any predetermined gas concentration is detected, for example 1% fuel gas in air. The gas sensors 21, 51 and control means 70 are preferably calibrated so that a particular signal from a gas sensor 21, 51 corresponds to a known concentration of gas.

The on/off switch to be engaged by the operator and which in this case is mounted on the operator's handle 16, shuts off suction by opening valve 27 which provides a much faster shut off than turning off the air pump 50 for example which would take time to slow down through inertia. However, the operator's on/off switch mounted in this case on handle 16 cannot override the opening of valve 28 as a result of a signal from a gas sensor 21, 51.

Since the movement of air through the components of the suction excavation system may generate static charge, this raises the possibility of sparks being generated which could possibly cause an explosion, especially if explosive gas is present. To prevent this, each component through which air is passed by the suction system is electrically bonded to each other to enable electrostatic charges to pass therebetween and the system is connected to earth, for example, via electrostatically conducting tyres or via an electrostatically conducting strap connected from the system to earth.

If desired, the control means 70 may be arranged to open valve 28 when any number of potentially explosive situations arise such as an overheating engine or drive belt or dangerously low oil levels. Again the manual reset will not be able to close the valve until the cause of the opening of the valve 27 has been rectified.

What is claimed is:

1. An excavating apparatus comprising:

an air pump for generating flow of air;

a nozzle through which air is drawn under the influence of the air pump, the nozzle being arranged when in use to suck up spoil from an excavation site; and means for separating spoil from the air drawn through the nozzle, wherein a fuel gas sensor is provided to detect for the presence of fuel gas in the flow of air drawn through the nozzle.

2. The excavating apparatus according to claim 1, wherein a valve is provided which when actuated is arranged to interrupt the passage of air through the nozzle.

3. The excavating apparatus according to claim 2, wherein a control means is provided to actuate the valve when the fuel gas sensor detects the presence of fuel gas in the air drawn through the nozzle.

4. The excavating apparatus according to claim 3, wherein the apparatus is provided with an inlet arranged to receive air which is substantially free from fuel gas and when the control means actuates the valve to interrupt the passage of air through the nozzle, air is instead drawn from the inlet to the air pump which continues operating so that air which is substantially free from fuel gas is flushed through the air pump.

5. The excavating apparatus according to claim 3, wherein the fuel gas sensor is arranged to detect the concentration of fuel gas in the flow of air drawn through the nozzle and the control means is arranged to actuate the valve when the concentration of fuel gas detected exceeds a predetermined value.

6. The excavating apparatus according to claim 3, wherein the control means is arranged to keep the valve actuated until a manual reset is activated and fuel gas is no longer detected by the fuel gas sensor or the fuel gas concentration detected has fallen below the predetermine value.

7. The excavating apparatus according to claim 2, wherein the nozzle is provided with a switch arranged to be controlled by an operator to actuate the valve to start and stop suction through the nozzle when desired.

8. The excavating apparatus according to claim 7, wherein the switch is arranged such that suction through the nozzle only occurs while pressure is applied to the switch.

9. The excavating apparatus according to claim 1, wherein the fuel gas sensor is provided in the suction path between the inlet of the nozzle and the separating means.

10. The excavating apparatus according to claim 9, wherein a second fuel gas sensor is provided in the suction path at an inlet to the air pump.

11. The excavating apparatus according to claim 1, wherein the separation means and the air pump are electrically connected to each other and to earth.

12. The excavating apparatus according to claim 11, wherein components of the apparatus through which air is passed, including the air pump, a flexible hose, extension pipes, and the nozzle, are also electrically connected to the separating means and the air pump.

* * * * *